US010181652B2

(12) United States Patent
Petros

(10) Patent No.: US 10,181,652 B2
(45) Date of Patent: Jan. 15, 2019

(54) ANTENNA DESENSITIZATION SYSTEM AND DESIGN METHOD THEREOF

(71) Applicant: Argy Petros, Coconut Creek, FL (US)

(72) Inventor: Argy Petros, Coconut Creek, FL (US)

(73) Assignee: Think Wireless Inc., Coconut Creek, FL (US)

( * ) Notice: Subject to any disclaimer, the term of this patent is extended or adjusted under 35 U.S.C. 154(b) by 220 days.

(21) Appl. No.: 15/238,671

(22) Filed: Aug. 16, 2016

(65) Prior Publication Data

US 2018/0054003 A1 Feb. 22, 2018

(51) Int. Cl.

| | |
|---|---|
| ***H01Q 1/40*** | (2006.01) |
| ***H01Q 19/02*** | (2006.01) |
| ***H01Q 1/50*** | (2006.01) |
| ***H01Q 1/42*** | (2006.01) |

(52) U.S. Cl.
CPC ..... *H01Q 19/021* (2013.01); *H01Q 1/425* (2013.01); *H01Q 1/50* (2013.01)

(58) Field of Classification Search
CPC ..... H01Q 19/021; H01Q 1/50; H01Q 1/425; H01Q 19/02; H01Q 1/42
USPC ..... 343/862, 702, 873
See application file for complete search history.

(56) References Cited

U.S. PATENT DOCUMENTS

| | | | | |
|---|---|---|---|---|
| 8,604,995 | B2 * | 12/2013 | Hammad | G06F 1/1616 343/702 |
| 2015/0061961 | A1 * | 3/2015 | Bayram | H01Q 1/243 343/862 |
| 2016/0118718 | A1 * | 4/2016 | Guterman | H01Q 1/2266 343/702 |

* cited by examiner

*Primary Examiner* — Jean B Jeanglaude

(57) ABSTRACT

Disclosed is an antenna desensitization system and a method for designing an antenna desensitization system. The system and method are operative to provide a configuration and positioning of an antenna desensitizer element, with respect to an antenna, to overcome a frequency detuning experienced during operation of such antenna. The antenna desensitizer element comprises one or a combination of more than one decoupling components selected from the group of a frequency selective surface, an electromagnetic band gap structure, a ferromagnetic material, an anisotropic material, a nanomaterial, a dielectric material, and a conductive material. The system and method are particularly suitable for reducing the antenna frequency detuning effects caused by an external agent, such as a user or operator of a mobile electronics device, during operation of such device.

13 Claims, 8 Drawing Sheets

Top View

Side View
Top View

ANTENNA DESENSITIZATION SYSTEM AND DESIGN METHOD THEREOF

FIELD OF THE INVENTION

The present invention relates to antenna systems and methods. More particularly, the present invention relates to antenna systems and to antenna system design methods for overcoming adverse effects caused by external agents during the operation of such antenna system.

BACKGROUND OF THE INVENTION

A number of portable electronic communication devices and systems exist for enabling a user for their mobile operation in multiple applications. Usually one or more antennas are required to support such operation. A conformal, and preferably hidden, antenna system configuration is a key element to facilitate the portability and to increase the aesthetic appeal of these devices. However, during device operation, most antennas are subject to signal obstruction and frequency detuning or offset due to the presence of external agents that may electromagnetically couple to the antenna. Normally the antenna system is configured to operate while physically mounted on the communication device. However, portable devices are subject to unpredictable operational conditions and the effects of both electrically conductive and dielectric surrounding materials may significantly impair the antenna performance.

This situation becomes more critical for antenna applications used in handheld electronic devices, such as phones, tablets, and computers, in which the user inherently may affect the antenna performance and overall functionality of the specific device. In particular the body parts of a user, including hands, fingers, and head, may drastically degrade the antenna operation. Moreover, the antenna performance may be affected even in operational conditions where the device is put on a desk, placed in a pocket, or hung on clothing or where conductive materials or dielectric materials are located within a radius of two wavelengths at the lowest frequency of operation in the medium where the antenna is operating. Accordingly, the design, aesthetics, and operational characteristics of a handheld electronic communications device may be severely restricted.

Recently, the demand for handheld devices has increasingly grown for multiple applications in the wireless communication industry. In order to provide antenna solutions for these devices, previous efforts have been made to implement wideband antenna elements, as described in U.S. Pat. No. 8,749,438 to Jenwatanawet et al. and U.S. Pat. No. 8,766,856 to Hsieh, et al. However, these efforts typically include using an antenna operating at frequency ranges larger than required to reduce or prevent antenna detuning out of the intended frequency band of operation. A major limitation of these approaches occurs where the antenna is exposed to transmit or receive spurious signals that may increase the noise level of and/or interfere with internal and external electronic systems.

More specifically, other attempts made to implement antenna solutions to overcome frequency detuning while complying with signal integrity standards set up by industry have not been successful. For example, although enclosing the antenna in a separate module may make the antenna less susceptible to being detuned by an external agent, this approach requires a larger size and more expensive solution which is in conflict with long-existing electronic industry trends. Similarly, the approaches attempting to implement multiple antenna elements operating at different frequency bands increase the size requirements of the device and demand for more circuitry complexity.

Additional efforts that have been made to develop an antenna system and method to design a desensitized antenna element are described in U.S. Pat. App. Publication No. 2015/0061961 by Bayram, et al. However, these efforts have faced certain challenges and limitations. A limitation of this approach is that the desensitized antenna element requires at least one electrical circuit component to be added to the antenna. Another limitation of this approach is that both the antenna and additional circuitry is intended to be incorporated as part of the overall device design. While this approach may mitigate antenna frequency detuning, it may not be used in devices in which the desensitized antenna element was not part of the original design. As a result, this approach may not only require increased cost and circuit complexity of a new device in which this solution is implemented, but also may not be suitable for other devices.

Accordingly, the use of a wireless device in an antenna-detuning environment or certain constrained operational conditions may be subject to unacceptable frequency detuning and subpar system performance. This have led to the implementation of antenna solutions that are more complex, costly, aesthetically unappealing, or more importantly, highly inefficient by using wideband antennas, adaptively tuned antenna elements, multiple antenna elements, or automatic mechanisms to increase the power transmitted by the device.

An approach to tackle the disadvantages of the prior art is to implement an antenna desensitization system that provides a configuration and positioning of an antenna desensitizer element, with respect to an antenna of an electronic device, to overcome a potential frequency detuning during operation of such antenna. The antenna desensitizer element may be integrated as part of the original design of the electronic device design or added on aftermarket. This approach improves the overall performance of the antenna system by reducing the antenna frequency detuning effects caused by an external agent, such as a user or the unexpected presence of a surrounding object, during operation of such device.

Currently, there is no well-established method of deterministically creating an antenna desensitization system unless an electrical circuit component is added and the system is a primary part of the original antenna design. Thus, there remains a need in the art for antenna systems and methods to desensitize antennas that are capable of a robust operation at the frequencies of intended operation, while avoiding the problems of prior art systems and methods.

SUMMARY OF THE INVENTION

An antenna desensitization system and a method for designing an antenna desensitization system are disclosed herein. One or more aspects of exemplary embodiments provide advantages while avoiding disadvantages of the prior art. The system and method are operative to provide a configuration and positioning of an antenna desensitizer element, with respect to an antenna, to overcome a frequency detuning experienced during operation of such antenna. The antenna desensitizer element comprises one or a combination of more than one decoupling components selected from the group of a frequency selective surface, an electromagnetic band gap structure, a ferromagnetic material, an anisotropic material, a nanomaterial, a dielectric material, and a conductive material. The system and method are particularly suitable for reducing the antenna frequency detuning effects caused by an external agent, such as a user or operator of a mobile electronics device, during operation of such device.

In general, an antenna may be frequency detuned under certain operational conditions, especially those caused by an external agent, such as a user or operator. Likewise, the frequency response of the antenna may be offset by electromagnetic coupling created between neighboring objects and the antenna. Typical approaches to implement an antenna desensitization system to mitigate antenna detuning include additional electronic components or using adaptively frequency-tuned antenna elements or multiple antenna elements. These solutions require external components that consume power and increase the size, cost, and complexity of the antenna system. Other approaches use adaptive power transmission, which increases power consumption and reduces the life of the device electronic components.

The antenna desensitization system disclosed herein is designed to mitigate adverse effects of external agents or surrounding objects, when the antenna is operating in a potentially antenna-detuning environment. The system includes a desensitizer element comprising at least one decoupling component. The desensitizer element comprises a decoupling material, including one or a combination of more than one of a frequency selective surface, electromagnetic band gap structure, ferromagnetic material, anisotropic material, nanomaterial, dielectric material, or conductive material. The combination of the antenna and the desensitizer element may provide and effective and efficient way to mitigate antenna detuning during operation of the antenna system. Moreover, the antenna desensitizer element may be added on to an existing electronic device or integrated as part of the original design of such device design.

An antenna desensitization system designed according to the method described herein is able to significantly decouple the effects caused by either an external agent or a surrounding object, during operation of the antenna, while taking into consideration the input impedance of the antenna element. The method enables the design of an antenna desensitization system to provide a configuration and positioning of an antenna desensitizer element, with respect to an antenna, to overcome a frequency detuning during operation of such antenna. This frequency detuning may be caused by electromagnetic coupling between the antenna and a user of or objects surrounding the antenna.

The configuration of the dimensional and operational parameters of the antenna desensitization system includes the step of identifying the location and key operational conditions of the antenna in which the frequency response of the antenna may be detuned by the adverse effects of either a user or electromagnetic coupling from materials surrounding the antenna during operation.

The method further includes the steps of reducing such undesired effects by designing and implementing one or more desensitizer elements for each of the identified key operational conditions. These elements are selected, shaped, and positioned to provide the most suitable configuration for the intended application of the antenna system, in terms of performance or other predetermined criteria, corresponding to a specific antenna or a device which operates using such antenna.

The method determines dimensional and operational parameters of the elements of the antenna desensitization system, such as the relative positioning of each element and the use of dielectric materials or other types of decoupling materials that may prevent adverse electromagnetic coupling that may detune or degrade the performance of such antenna or a device which operates using such antenna. The antenna desensitization system and method are able to provide a robust design against frequency detuning, at the frequencies of intended operation, and a potential reduction of undesired electromagnetic coupling, as compared to designs using standard techniques, by integrating a desensitizer element with such antenna. This results in antenna system designs that meet or exceed challenging industry standards, in terms of antenna performance or signal integrity of both internal and external systems.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description of particular embodiments of invention is set out to enable one to practice an implementation of the invention and is not intended to limit the invention to any specific embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
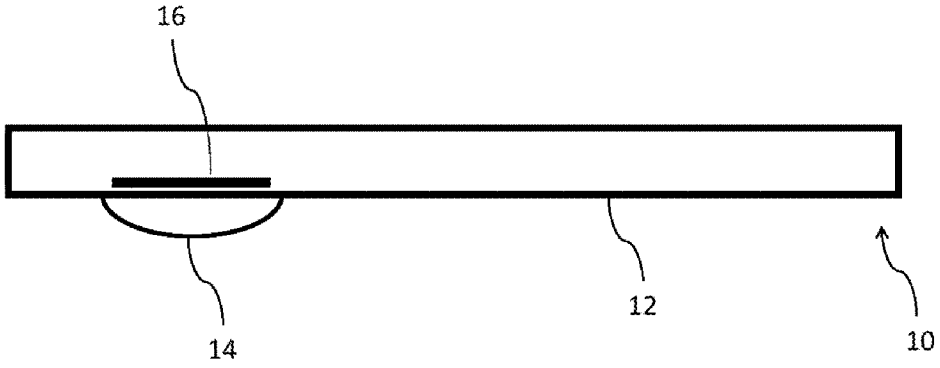
FIG. 1 shows a cross-sectional side view of a wireless device using an antenna desensitization dielectric material in accordance with an exemplary embodiment.

In accordance with certain aspects of a configuration of the invention, a side view of a wireless device 10, using an antenna desensitization dielectric material 14, is shown in FIG. 1. Wireless device 10 is represented by a cell phone, comprising an antenna 16 enclosed within an outer surface 12 of cell phone 10 and adjacent to a side of outer surface 12 of cell phone 10. Under certain operational conditions, the performance of antenna 16 may be degraded by frequency detuning caused by the electromagnetic coupling effects caused by external agents or factors.

These agents include the presence of any combination of human user body parts (e.g. hands, fingers, head or other parts of the body as when such device is placed in a pocket or hung on clothing), conductive materials, or dielectric materials located within a radius of two wavelengths at the lowest frequency of operation in the medium where said antenna element is operating. In particular, the degradation of performance of antenna 16 results more significant where such external agents influence an area of outer surface 12 closer to antenna 16. In other words, a largest impact on the degradation of the performance of antenna 16 occurs where an affecting agent is in the vicinity of antenna 16. Specifically, antenna 16 is more sensitive to an affecting agent located around the area of outer surface 12 that is adjacent to antenna 16. More specifically, antenna 16 will be most susceptible to an agent positioned within 5 mm of antenna 16.

In some cases, the degradation of the performance of antenna 16 may reach up to levels in which cell phone 10 may no longer operate. In certain instances, the reduction in the performance of antenna 16 may be overcome by an automatic increase of the power transmitted by cell phone 10. However, more power would be consumed and the battery charge of cell phone 10 would be more rapidly depleted. Additionally, a performance degradation of antenna 16 may result in a compromised signal integrity of device 10 with increased adverse effects caused by noise signals and interference signals transmitted or received by antenna 16.

In particular, for cell phone 10, during normal operation the hand of a user may certainly be placed in the vicinity of outer surface 12 of cell phone 10, causing a severe impact on the performance of cell phone 10. Thus, in the configuration shown in FIG. 1, dielectric material 14 is disposed on the area of outer surface 12 that is adjacent to antenna 16, such that dielectric material 14 overlaps an area defined by antenna 16. As a result, a spacing between antenna 16 and an external agent that may electromagnetically couple to antenna 16 is increased, reducing the impact that said external agent may have on antenna 16. Preferably, dielectric material 14 has a relative dielectric permittivity close to the relative dielectric permittivity of air to minimize the impact on antenna 16. However, a design of antenna 16 may be optimized to operate with dielectric material 14.

Typically, dielectric material 14 is disposed on an area of outer surface 12 of cell phone 10 that is larger than the area of antenna 16 adjacent to outer surface 12 of cell phone 10. Preferably, dielectric material 14 has a thickness ranging between 1 mm and 10 mm. More preferably, dielectric material 14 has a thickness not larger than 5 mm. In this particular configuration, dielectric material 14 has a hemispherical shape with a maximum separation of approximately 5 mm from outer surface 12 of cell phone 10. Dielectric material may be affixed to outer surface 12 of cell phone 10, by means that include glue, adhesive, or resin as well known to those skilled in the art.

Figure 2:
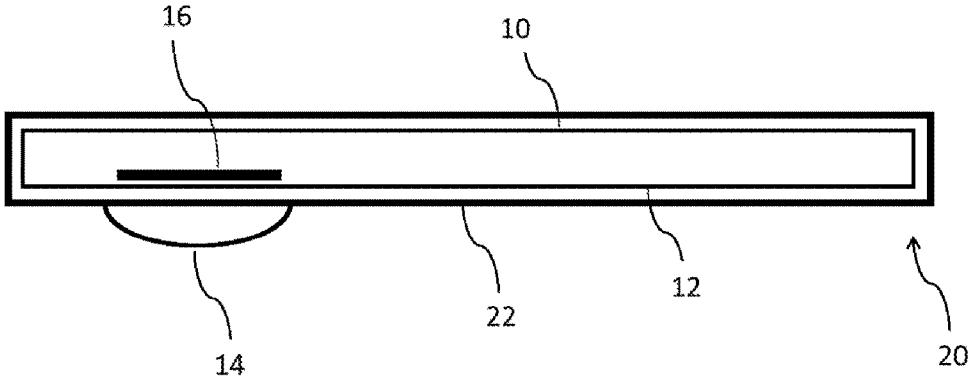
FIG. 2 shows a cross-sectional side view of a wireless device with a surrounding case using an antenna desensitization dielectric material in accordance with another exemplary embodiment.

According to another configuration, FIG. 2 shows a cross-sectional side view of device 10 surrounded by a case 20. In this embodiment, dielectric material 14 is disposed on the area of outer surface 22 of case 20, such that dielectric material 14 overlaps an area defined by antenna 16. As a result, a spacing between antenna 16 and an external agent that may electromagnetically couple to antenna 16 is increased, reducing the impact that said external agent may have on antenna 16. Preferably, dielectric material 14 has a relative dielectric permittivity close to the relative dielectric permittivity of air to minimize the impact on antenna 16. However, a design of antenna 16 may be optimized to operate with dielectric material 14.

In this configuration, case 20 is representative of a protective case against scratches, dents, or minor bumps that device 10 may suffer during normal use. However, other uses of case 20 include decorative, convenience, personalized preference or other purposes, as known in the prior art. Preferably, dielectric material 14 is disposed on an area of outer surface 22 of case 20 that is larger than the area of antenna 16 adjacent to outer surface 22 of case 20. Preferably, dielectric material 14 has a thickness ranging between 1 mm and 10 mm. More preferably, dielectric material 14 has a thickness not larger than 5 mm. In this particular configuration, dielectric material 14 has a hemispherical shape with a maximum separation of approximately 5 mm from outer surface 22 of case 20. Dielectric material may be affixed to outer surface 22 of case 20, by means that include glue, adhesive, or resin as well known to those skilled in the art.

Figures 3A, 3B, 3C, 3D, 3E, 3F, 3G, 3H, 3I, 3J, 3K, 3L, 3M, 3N, 3P:
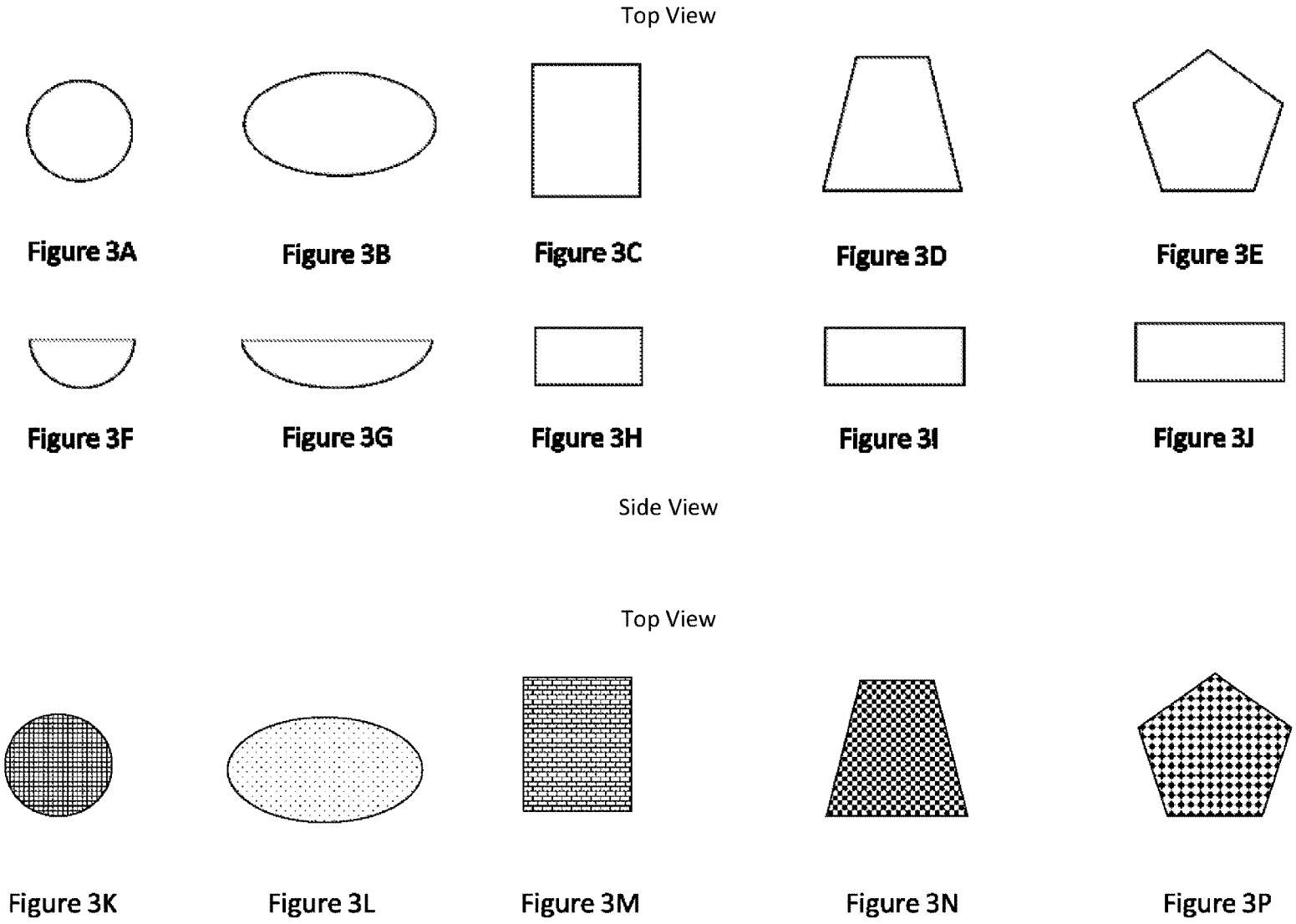
FIGS. 3A to 3P show various aspects of different shapes of an antenna desensitizer element.

FIGS. 3A to 3P show various aspects of different shapes that an antenna desensitizer element formed by dielectric material 14 may take to be attached to device 10 or case 20 for desensitization of antenna 16 of device 10. More specifically, FIGS. 3A to 3E show a top view of a solid design of dielectric material 14, having a circular, elliptical, rectangular, trapezoidal, and pentagonal cross-section, respectively. Likewise, FIGS. 3F to 3J show a corresponding side view of the solid design of dielectric material 14. Thus, FIG. 3A is the top view of a design of dielectric material 14 for which FIG. 3F is its corresponding side view. Similarly, FIGS. 3B, 3C, 3D, and 3E correspond to FIGS. 3G, 3H, 3I, and 3J, respectively. In particular, FIGS. 3K to 3P show a top view of a patterned design of dielectric material 14, having a circular, elliptical, rectangular, trapezoidal, and pentagonal cross-section, respectively.

Those skilled in the art will realize that other designs of dielectric material 14 may be created, including a label, logo, word, name, symbol, picture, photo, text, map, or any combination thereof for use not only in a case for a cellphone, but also including uses on a laptop computer, tablet, cellphone, touch-screen display device, or different type of handheld devices.

Figure 4A:
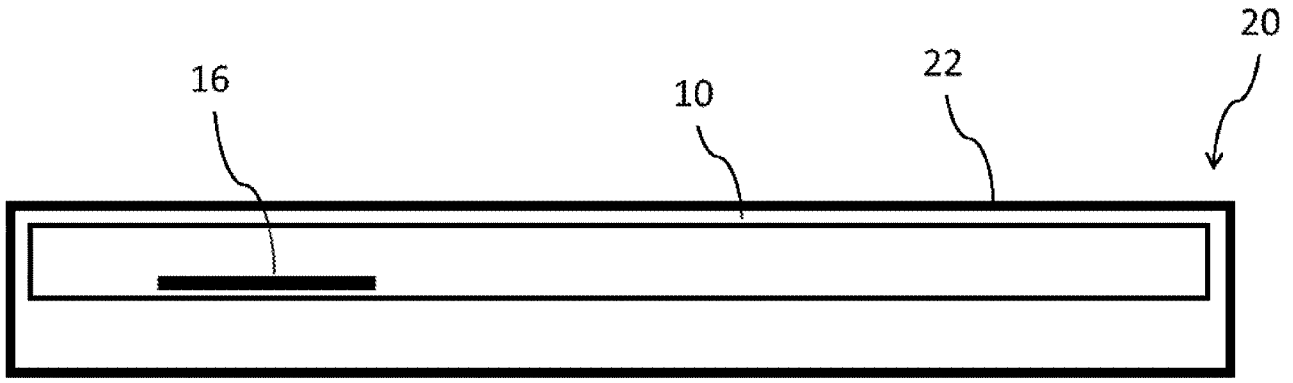
FIGS. 4A to 4C show various aspects of a wireless device with a surrounding antenna desensitization case in accordance with different exemplary embodiments.
Figure 4B:
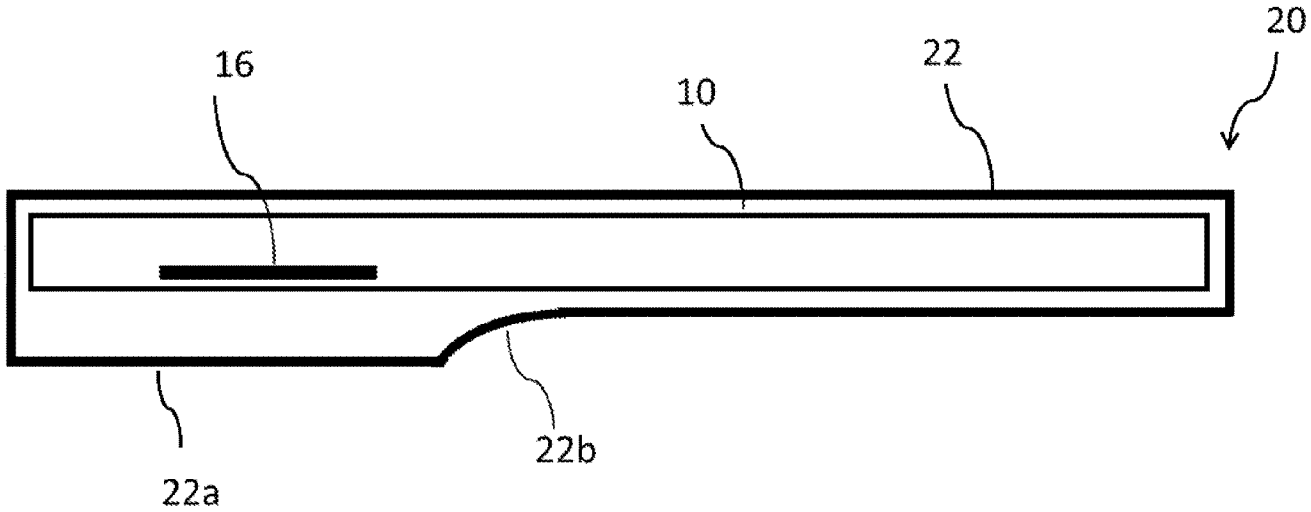
Figure 4C:
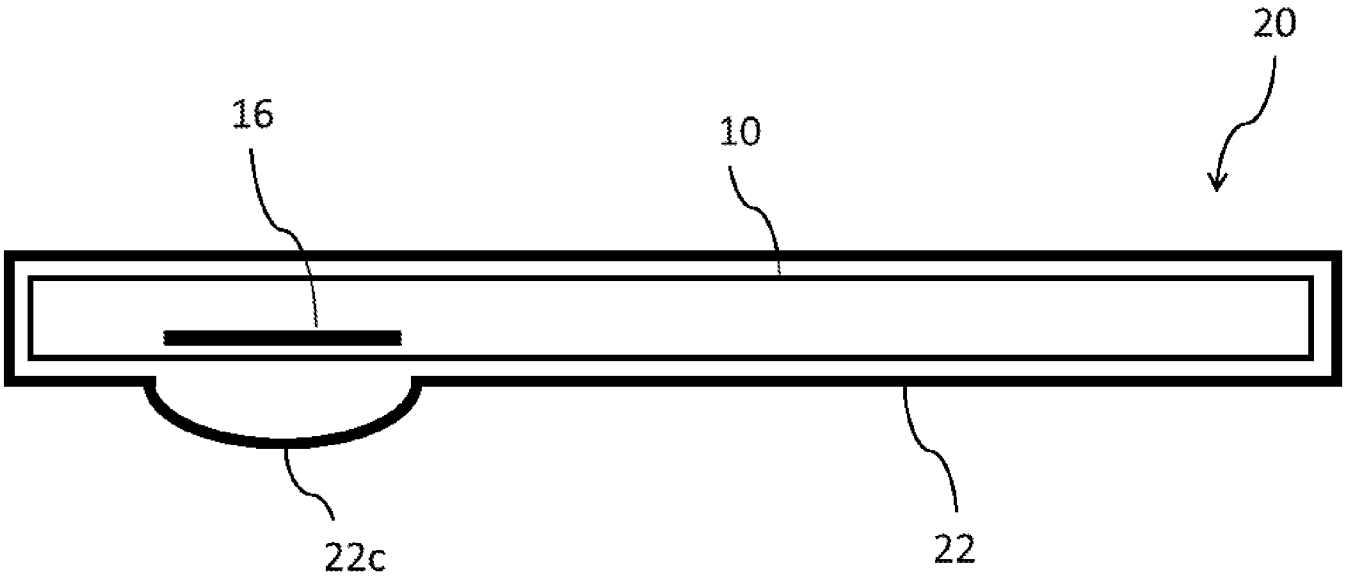

In accordance with another configuration, FIGS. 4A to 4C show various aspects of device 10 surrounded by case 20, wherein the spacing between antenna 16 and outer surface 22 of case 20 is larger than the minimum spacing required to provide the benefits of case 20. Although a larger spacing results in a larger size of case 20, antenna 16 becomes less sensitive to an external agent that may otherwise electromagnetically couple stronger to antenna 16, which may cause a degradation of performance of antenna 16. Preferably, case 20 has a thickness such that the spacing between device 10 and outer surface 22 of case 20 ranges between 1 mm and 10 mm on the region adjacent to antenna 16. More preferably, such spacing is not larger than 5 mm. In this configuration, air is filling the spacing between antenna 16 and outer surface 22 of case 20 to reduce the weight of case 20. However, those skilled in the art will realize that one or more layers of dielectric material other than air may be disposed in between antenna 16 and outer surface 22 of case 20.

Particularly, FIG. 4A shows a cross-sectional side view of device 10 surrounded by case 20, wherein outer section 22 of case 20 has a rectangular cross-section. More specifically, FIG. 4B shows a cross-sectional side view of device 10 surrounded by case 20, wherein the spacing between antenna 16 and outer surface 22 of case 20 is larger than the minimum spacing required only in a section 22*a* of outer surface 22 of case 20. Section 22*a* defines a largest uniform spacing between device 10 and outer surface 22 on the area where antenna 16 is disposed. In other words, the spacing between device 10 and outer surface 22 is smaller, in all regions between device 10 and case 22, than the spacing between device 10 and section 22*a* of case 20. The spacing between device 10 and outer surface 22 of case 20 transitions from the largest to the smallest values at section 22*b*, which has a curved concave cross-section from an external view of case 20.

Likewise, FIG. 4C shows a cross-sectional side view of device 10 surrounded by case 20, wherein a section 22*c* of outer surface 22 of case 20 defines a region having a hemispherical shape. Preferably, the region of outer surface 22 of case 20 defined by section 22*c* has an area that overlaps and is larger than the area of antenna 16 adjacent to outer surface 22 of case 20.

Figure 5A:
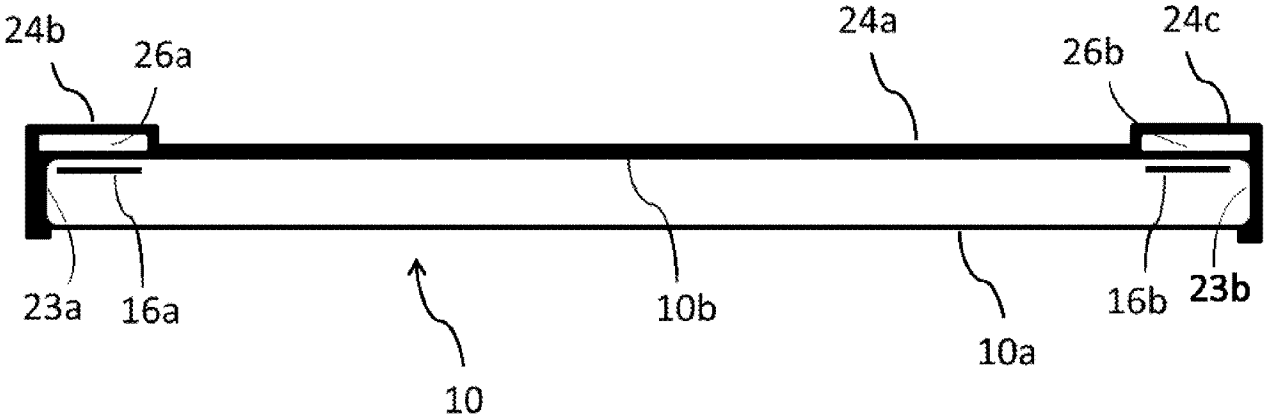
FIGS. 5A to 5B show various aspects of a cross-sectional side view of a wireless device with an antenna desensitization case in accordance with another exemplary embodiment.
Figure 5B:
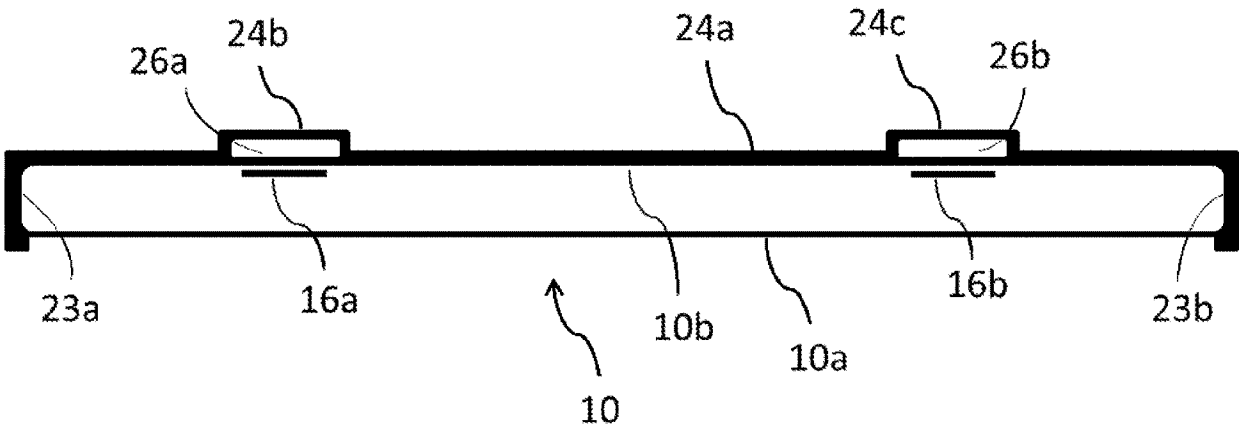

In yet another configuration, FIGS. 5A and 5B show various aspects of a cross-sectional side view of device 10, represented by a cell phone comprising a front side 10*a*, wherein a user interfaces for normal operation of cell phone 10, and a back side 10*b* opposite front side 10*a*. Cell phone 10 also comprises a first antenna 16*a*, positioned adjacent to back side 10*b* towards a first end 23*a* of cell phone 10, and a second antenna 16*b* positioned adjacent to back side 10*b* towards a second end 23*b* of cell phone 10 opposite first end 23*a* of cell phone 10.

A case comprising a first section 24*a*, a second section 24*b*, and a third section 24*c* attaches to cell phone 10 overlapping an area defined by back side 10*b*, an area defined by first end 23*a*, and an area defined by second end 23*b* of cell phone 10. Section 24*a* is positioned contiguous to and in between sections 24*b* and 24*c*, whereas a part of section 24*b* and a part of section 24*c* protrudes away from cell phone 10 in the areas adjacent to antennas 16*a* and 16*b*. A protrusion of a part of sections 24*b* and 24*c* desensitizes antennas 16*a* and 16*b* by increasing the spacing between antennas 16*a* and 16*b* and an external agent that may otherwise electromagnetically couple to and degrade the performance of antenna 16*a* or antenna 16*b*.

In this specific configuration, sections 24*b* and 24*c* create air gaps 26*a* and 26*b* in between cell phone 10 and sections 24*b* and 24*c*, respectively. Preferably, sections 24*b* and 24*c* protrude away from cell phone 10 such that the spacing between back side 10*b* and the outer surface of sections 24*b* and 24*c* ranges between 1 mm and 10 mm on the region adjacent to antennas 16*a* and 16*b*. More preferably, such spacing is not larger than 5 mm. However, those skilled in the art will realize that one or more layers of dielectric material other than air may be used to create the protrusion of sections 24*b* and 24*c*.

In addition, sections 24*b* and 24*c* extend contiguously to cell phone 10 to attach to cell phone 10 at ends 23*a* and 23*b* by means of a lip at the edge of each section 24*b* and 24*c* towards front end 10*a* of cell phone 10, as well known in the prior art.

In particular, FIG. 5A shows a side view of cell phone 10, wherein antennas 16*a* and 16*b* of cell phone 10, and correspondingly sections 24*b* and 24*c*, are located adjacent to ends 23*a* and 23*b* of cell phone 10, respectively. FIG. 5B specifically shows a side view of cell phone 10, wherein antennas 16*a* and 16*b* of cell phone 10, and correspondingly sections 24*b* and 24*c*, are spaced from ends 23*a* and 23*b* of cell phone 10, respectively.

Figure 6A:
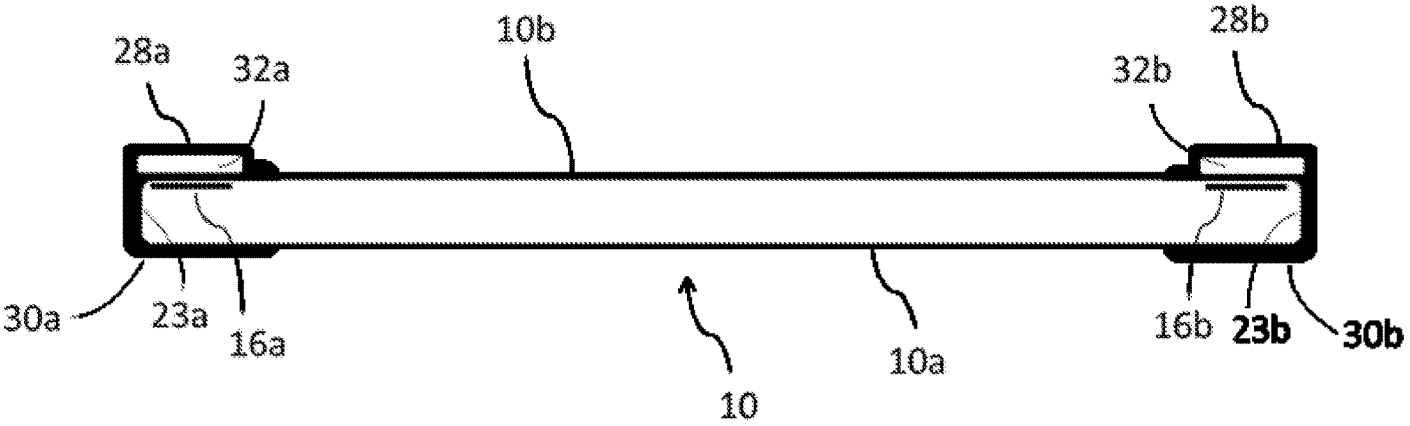
FIGS. 6A and 6B show various aspects of a wireless device with a plurality of antenna desensitization elements in accordance with another exemplary embodiment.
Figure 6B:
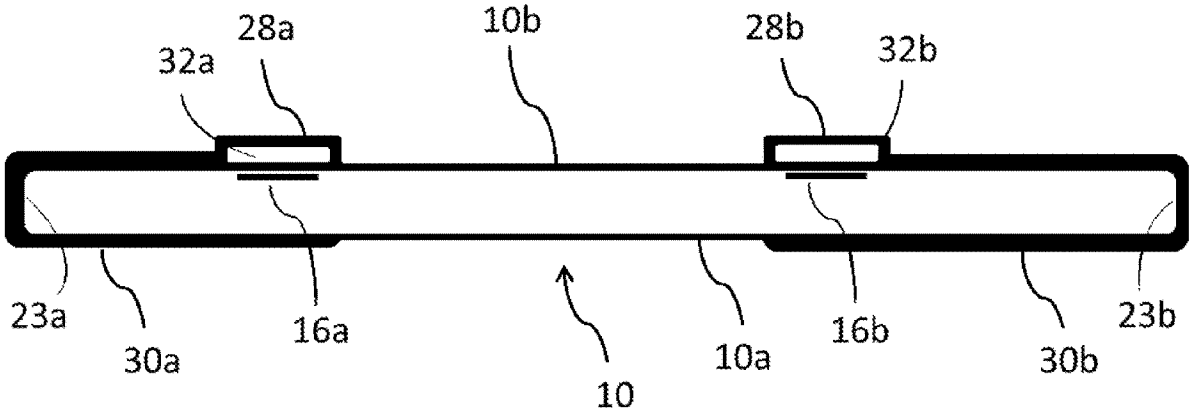

FIGS. 6A and 6B show various aspects of a wireless device with a plurality of antenna desensitization elements in accordance with another exemplary embodiment. In this configuration, device 10 is represented by a cell phone comprising a front side 10*a*, wherein a user interfaces for normal operation of cell phone 10, and a back side 10*b* opposite front side 10*a*. Cell phone 10 also comprises a first antenna 16*a*, positioned adjacent to back side 10*b* towards a first end 23*a* of cell phone 10, and a second antenna 16*b* positioned adjacent to back side 10*b* towards a second end 23*b* of cell phone 10 opposite first end 23*a* of cell phone 10.

A first insert or cap 30*a* and a second insert or cap 30*b* attach contiguously to cell phone 10 overlapping an area defined by antennas 16*a* and 16*b* of cell phone 10, respectively. Each of inserts 30*a* and 30*b* comprises a section 28*a* and a section 28*b* that protrudes away from cell phone 10 in the areas adjacent to antennas 16*a* and 16*b*. Sections 28*a* and 28*b* desensitizes antennas 16*a* and 16*b* by increasing the spacing between antennas 16*a* and 16*b* and an external agent that may otherwise electromagnetically couple to and degrade the performance of antenna 16*a* or antenna 16*b*. In addition, sections 28*a* and 28*b* attach to cell phone 10 at ends 23*a* and 23*b* by means of a lip at one or more edges of front side 10*a* of cell phone 10, as well known in the prior art.

In this specific configuration, sections 28*a* and 28*b* create air gaps 32*a* and 32*b* in between cell phone 10 and sections 28*a* and 28*b*, respectively. Preferably, sections 28*a* and 28*b* protrude away from cell phone 10 such that the spacing between back side 10*b* and the outer surface of sections 28*a* and 28*b* ranges between 1 mm and 10 mm on the region adjacent to antennas 16*a* and 16*b*. More preferably, such spacing is not larger than 5 mm. However, those skilled in the art will realize that one or more layers of dielectric material other than air may be used to create the protrusion of sections 28*a* and 28*b*.

Specifically, FIG. 6A shows a side view of cell phone 10, wherein antennas 16*a* and 16*b* of cell phone 10, and correspondingly inserts 30*a* and 30*b*, are located adjacent to ends 23*a* and 23*b* of cell phone 10, respectively. In particular, FIG. 6B shows a side view of cell phone 10, wherein antennas 16*a* and 16*b* of cell phone 10, and correspondingly inserts 34*a* and 34*b*, are spaced from ends 23*a* and 23*b* of cell phone 10, respectively.

Figure 7:
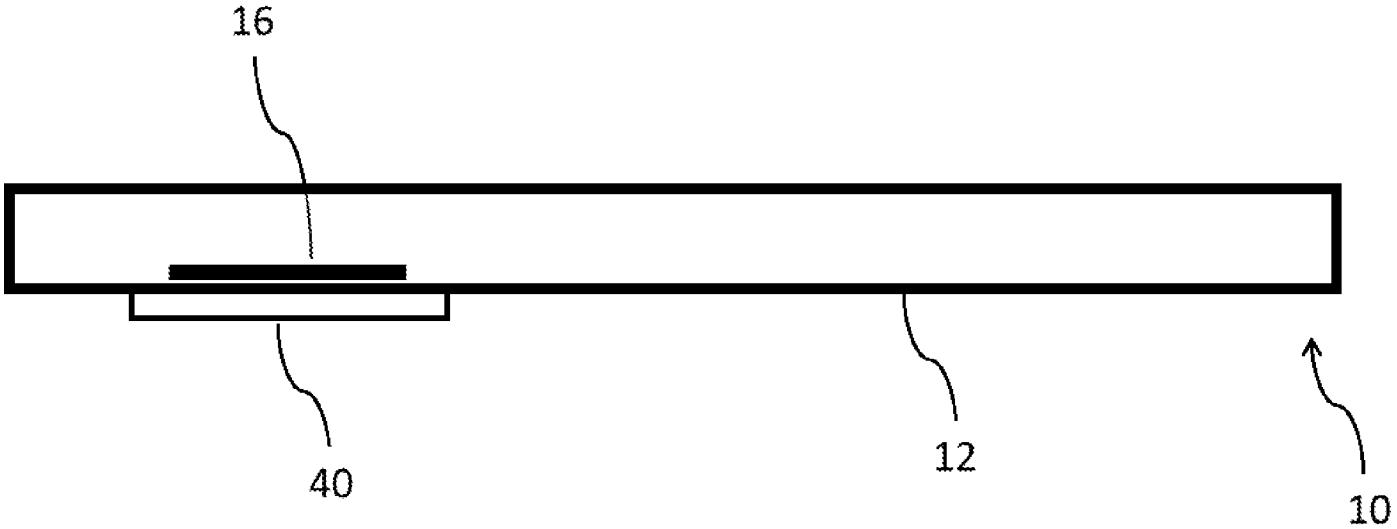
FIG. 7 shows a cross-sectional side view of a wireless device using an antenna desensitization decoupling material in accordance with another exemplary embodiment.

In accordance with certain aspects of another configuration, a cross-sectional side view of a wireless device 10, using an antenna desensitization decoupling material 40, is shown in FIG. 7. Wireless device 10 is represented by a cell phone, comprising an antenna 16 enclosed within an outer surface 12 of cell phone 10 and adjacent to a side of outer surface 12 of cell phone 10.

In the configuration shown in FIG. 7, decoupling material 40 is disposed on the area of outer surface 12 of cell phone 10 that is adjacent to antenna 16, such that decoupling material 40 overlaps an area defined by antenna 16. Preferably, a thickness of decoupling material 40 is not larger than 3 mm. As a result, a spacing between antenna 16 and an external agent that may electromagnetically couple to antenna 16 is usually not increased enough to reduce the impact, due to spacing, that said external agent may have on antenna 16. However, and more importantly, decoupling material 40 has electrical and magnetic properties that minimize an effect between antenna 16 and an external agent that may electromagnetically couple to antenna 16 causing a degradation of the performance of antenna 16, even at such small spacing.

Decoupling material 40 may comprise one or a combination of more than one layer of a frequency selective surface, electromagnetic band gap structure, ferromagnetic material, anisotropic material, nanomaterial, dielectric material, or conductive material. A design of antenna 16 may be optimized to operate with decoupling material 40. Those skilled in the art will realize that decoupling material 40 may be also used as part of a means for including a label, logo, word, name, symbol, picture, photo, text, map, or any combination thereof. Preferably, decoupling material 40 is disposed on an area of outer surface 12 of cell phone 10 that is larger than the area of antenna 16 adjacent to outer surface 12 of cell phone 10. Also, decoupling material may be affixed to outer surface 12 of cell phone 10, by means that include glue, adhesive, or resin as well known to those skilled in the art.

Figure 8A:
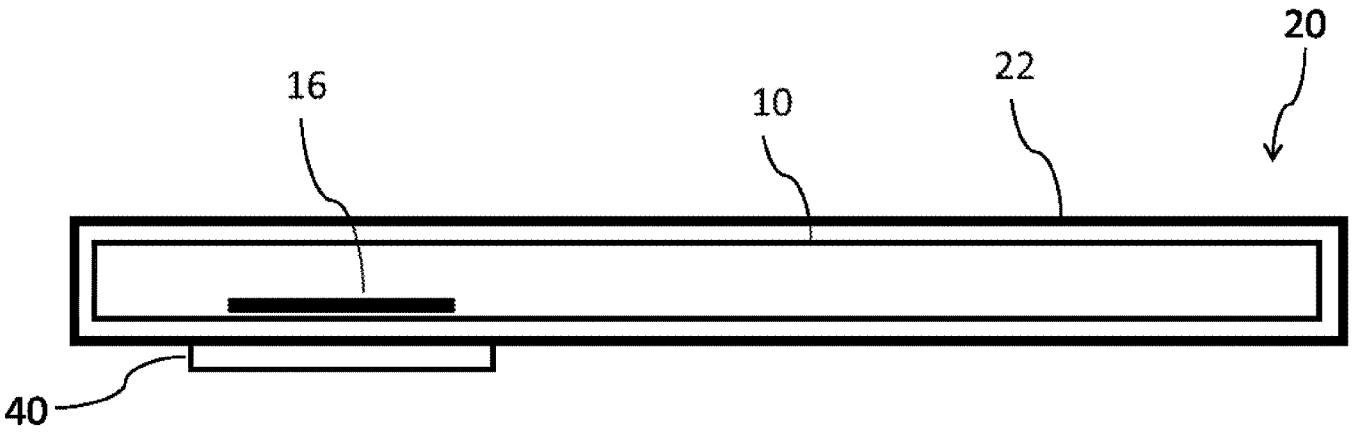
FIGS. 8A and 8B show various aspects of a cross-sectional side view of wireless device surrounded by a case using an antenna desensitization decoupling material in accordance with different exemplary embodiments.
Figure 8B:
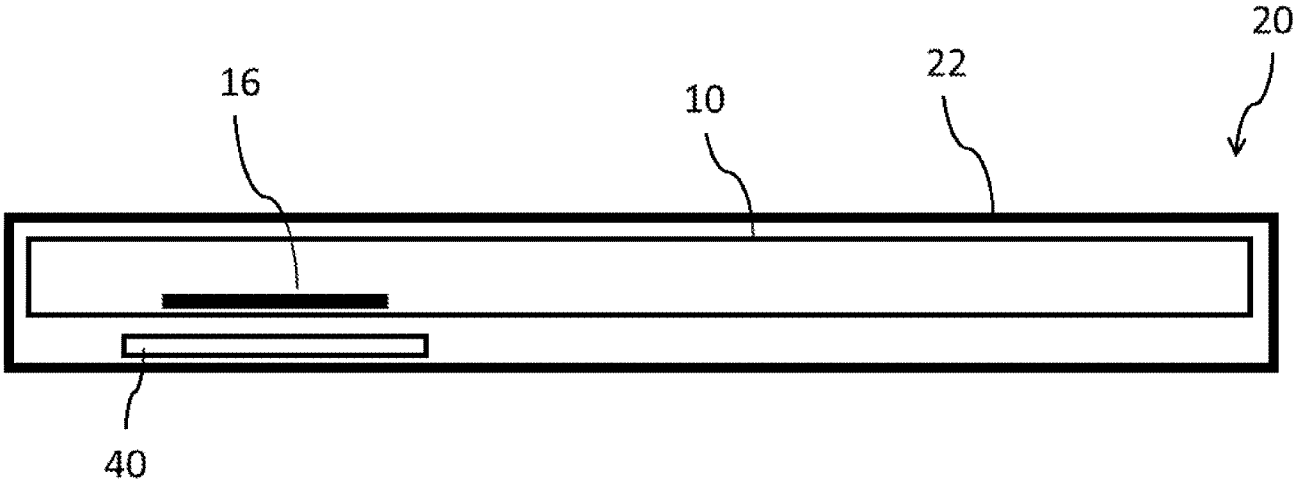

According to another configuration, FIGS. 8A and 8B show various aspects of a cross-sectional side view of device 10 surrounded by case 20. In this embodiment, decoupling material 40 is disposed on an area of an outer surface 22 of case 20, such that decoupling material 40 overlaps an area defined by antenna 16 adjacent to outer surface 22 of case 20. As a result, decoupling material 40 desensitizes antenna 16 by reducing an effect of an external agent that may electromagnetically couple to antenna 16 causing a degradation of the performance of antenna 16.

In particular, FIG. 8A shows a cross-sectional side view of device 10 surrounded by case 20, wherein decoupling material 40 is disposed on outer surface 22 of case 20. Specifically, FIG. 8B shows a cross-sectional side view of device 10 surrounded by case 20, wherein decoupling material 40 is disposed within outer surface 22 of case 20.

Alternatively, and in reference to FIGS. 1 to 2 and 4 to 8, antenna 16 may be disposed partly enclosed or not enclosed at all within the outer surface of wireless device 10.

In reference to each of the above-described configurations, a method for designing an antenna desensitization system to mitigate adverse effects when operating in a potentially antenna-detuning environment or under conditions that may interfere with other systems or be susceptible to interference from other sources may be performed according to the following:

1. At step 10, identifying the location of an antenna operating in an environment capable of detuning the operational frequency range of said antenna or under conditions in which said antenna may interfere with the operation of other systems or may be susceptible to noise or interference from other sources.

2. Next, at step 20, determining the operational conditions wherein the antenna, whose location was identified in step 1, might be susceptible to either a unique or significant detuning or performance degradation. These operational conditions may include, but are not limited to, the presence of any combination of human user body parts (e.g. hands, fingers, head or other parts of the body as when such device is placed in a pocket or hung on clothing), conductive materials, or dielectric materials located within a radius of two wavelengths at the lowest frequency of operation in the medium where said antenna element is operating, corresponding to an intended application (e.g. antennas on a laptop computer, tablet, cellphone, touch-screen display device, or different type of handheld devices.

3. Next, at step 30, designing and implementing one or more desensitizer elements for each of the operational conditions identified in step 2, to mitigate or eliminate the adverse effects of each of these conditions, by implementing at least one of the following steps:

3.1. Designing a structure, including a dielectric material, disposed adjacent to and at least partly overlapping such antenna, in order to increase the spacing between the antenna and an external agent creating each operational condition;

3.2. Designing a structure, including a dielectric material and an insert or at least a portion of a case at least partly enclosing an electronic device operating in association with the antenna identified in step 1, wherein said dielectric material is disposed adjacent to and at least partly overlapping said antenna element, in order to increase the spacing between the antenna and an external agent creating each operational condition; and 3.3. Designing a structure, including a decoupling material disposed adjacent to and at least partly overlapping such antenna, in order to reduce the electromagnetic coupling between the antenna and an external agent creating each operational condition;

4. Last, at step 40, selecting the most suitable configuration of each desensitizer element, in terms of performance or other predetermined criteria, corresponding to a specific antenna or a device which operates using such antenna.

The method determines dimensional and operational parameters of the elements of the antenna desensitization system, such as the relative positioning of each element and the use of dielectric materials or other types of decoupling materials that may prevent adverse electromagnetic coupling that may detune or degrade the performance of such antenna or a device which operates using such antenna.

Those skilled in the art will recognize that the steps above indicated can be correspondingly adjusted for specific antenna element configurations and other constraints such as antenna dimensions, conformality, obtrusiveness, operating frequency, bandwidth, operational conditions, number of antennas, and surrounding environment as well as available area and location for implementation of each antenna in a particular device for a specific application.

The method and different configurations of the antenna desensitization system and design method thereof have been described herein in an illustrative manner, and it is to be understood that the terminology which has been used is intended to be in a descriptive rather than in a limiting nature. Any embodiment herein disclosed may include one or more aspects of the other embodiments. The exemplary embodiments were described to explain some of the principles of the present invention so that others skilled in the art may practice the invention. Those skilled in the art will recognize that many modifications and variations of the invention are possible in light of the above teachings. The present invention may be practiced otherwise than as specifically described within the scope of the appended claims and their legal equivalents.

I claim:

1. An antenna desensitization case for at least partly enclosing an electronic device, said device comprising an antenna element, and said case comprising:

a shell having an inner surface and an outer surface;

at least one peripheral sidewall; and a desensitizer element;

wherein said at least one peripheral sidewall is physically attached to at least one of said inner and outer surfaces; wherein said case is disposed on said electronic device, such that said desensitizer element at least partly overlaps said antenna element; wherein said antenna element operates at a frequency band susceptible to a detuning effect caused by an external agent during operation of said antenna element; and wherein said desensitizer element is positioned on said case such that said detuning effect is reduced.

2. The antenna desensitization case of claim 1, wherein said electronic device at least partly encloses said antenna element.

3. The antenna desensitization case of claim 1, wherein said desensitizer element electromagnetically couples to said antenna element.

4. The antenna desensitization case of claim 1, wherein said desensitizer element is structurally integrated with said case.

5. The antenna desensitization case of claim 4, wherein said desensitizer element is embedded in said case.

6. The antenna desensitization case of claim 1, wherein said desensitizer element is at least partly disposed on at least one of said inner surface, said outer surface, and said at least one peripheral sidewall of said case.

7. The antenna desensitization case of claim 1, wherein said desensitizer element thickens a cross-section profile of said case.

8. The antenna desensitization case of claim 1, further comprising a decorative element.

9. The antenna desensitization case of claim 8, wherein said decorative element comprises an item selected from the group of a label, logo, word, name, symbol, picture, photo, text, animal representation, geographical region, and map.

10. The antenna desensitization case of claim 1, wherein said desensitizer element comprises one or a combination of more than one decoupling components selected from the group of a frequency selective surface, an electromagnetic band gap structure, a ferromagnetic material, an anisotropic material, a nanomaterial, a dielectric material, and a conductive material.

11. A method for designing an antenna desensitization system, comprising:

a. providing a first electronic device comprising:
an antenna element and
a desensitizer element;

wherein said desensitizer element is disposed at least partly overlapping said antenna element;

and wherein said desensitizer element at least partly prevents a condition selected from the group of: a frequency detuning of said antenna element caused by an external agent during operation of said first electronic device, a radiofrequency interference received by said antenna element and caused by an external agent during operation of said first electronic device, and a radiofrequency interference transmitted by said antenna element affecting an external second electronic device during operation of said first electronic device;

b. identifying a location of said antenna element;

c. determining said condition during operation of said first electronic device;

d. designing and implementing a desensitizer element to at least partly reduce said condition during operation of said first electronic device; and e. selecting a most suitable configuration of said desensitizer element, in terms of performance or other predetermined criteria of said first electronic device under said condition.

12. The method of claim 11, wherein designing said desensitizer element further comprises at least one of the following steps:

a. designing a structure, including a dielectric material disposed adjacent to and at least partly overlapping said antenna element, in order to increase a spacing between said antenna element and said external agent, b. designing a structure, including a dielectric material and at least a portion of a case to at least partly enclose said first electronic device, said dielectric material disposed adjacent to and at least partly overlapping said antenna element, in order to increase a spacing between said antenna element and said external agent;

c. designing a structure, including a dielectric material and an insert, said dielectric material disposed adjacent to and at least partly overlapping said antenna element, in order to increase a spacing between said antenna element and said external agent; and d. designing a structure, including a decoupling material disposed adjacent to and at least partly overlapping said antenna element, in order to reduce an electromagnetic coupling between said antenna element and said external agent.

13. The method of claim 11, wherein said antenna desensitization system further comprises a case for at least partly enclosing said first electronic device, said case comprising a shell having an inner surface and an outer surface and at least one peripheral sidewall, wherein said at least one peripheral sidewall is physically attached to at least one of said inner and outer surfaces.

* * * * *